US006067278A

United States Patent [19]

Owens et al.

[11] Patent Number: 6,067,278

[45] Date of Patent: May 23, 2000

[54] DIGITAL RECORDER FOR CAR RADIO

[75] Inventors: Kenneth R. Owens, Lake Mary, Fla.; Bart Hrvatin, Chicago, Ill.

[73] Assignee: Recoton Corporation, Lake Mary, Fla.

[21] Appl. No.: 09/055,628

[22] Filed: Apr. 6, 1998

[51] Int. Cl.[7] ..... H04H 9/00

[52] U.S. Cl. ..... 369/7; 369/25; 704/270

[58] Field of Search ..... 369/7, 29, 25; 704/270, 201, 103; 395/2.79; 341/110; 711/103; 364/400.01; 340/568

[56] References Cited

U.S. PATENT DOCUMENTS

| | | | |
|---|---|---|---|
| 4,287,568 | 9/1981 | Lester . | |
| 4,713,801 | 12/1987 | Hale | 369/7 |
| 4,963,866 | 10/1990 | Duncan | 341/110 |
| 5,263,199 | 11/1993 | Barnes et al. | 455/344 |
| 5,459,702 | 10/1995 | Greenspan | 369/25 |
| 5,491,774 | 2/1996 | Norris et al. | 395/2.79 |
| 5,633,837 | 5/1997 | Gantt | 369/7 |
| 5,696,928 | 12/1997 | Grewe et al. | 711/103 |
| 5,787,399 | 7/1998 | Lee et al. | 704/270 |
| 5,798,921 | 8/1998 | Johnson et al. | 364/400.01 |
| 5,835,015 | 11/1998 | Ikeda | 340/568 |
| 5,839,108 | 11/1998 | Daberko et al. | 704/270 |
| 5,860,065 | 1/1999 | Hsu | 704/270 |

*Primary Examiner*—Ali Neyzari
*Assistant Examiner*—Kim-Kwok Chu
*Attorney, Agent, or Firm*—Levisohn, Lerner, Berger & Langsam

[57] ABSTRACT

An automobile radio/digital recording system is provided in which a digital recorder enables input either through the radio or through a microphone to be stored in the digital storage device and be played back through the automobile's radio system. Storage of information in excess of five minutes is available.

21 Claims, 3 Drawing Sheets

FROM JENSEN XCC 8220
+5V
VR
IN OUT
LT1121
GND
+3.3V
C1 1uF
GND
30
32
R1
38
36
R3
R2
34
U1
Z8C02
1 P24
2 P25
3 P26
4 P27
5 VCC
6 XTAL2
7 XTAL1
8 P31
9 P32
P2318
P2217
P2116
P2015
GND14
P0213
P0112
P0011
P0310
40
RECORD
GND
42
PLAY
TO MUTE LINE OF JENSEN XCC8220
U2
44
1 SS
2 MOSE
3 MISO
4 WSSD
5 NC
6 NC
7 NC
8 NC
9 NC
10 NC
11 VSSA
12 VSSA
13 AUD.OUT
14 AM CAP
BCLK 28
VCCD 27
XCLK 26
INT 25
RAC 24
VSSA 23
NC22
NC21
NC20
NC19
VCCA18
+ANA IN17
-ANA IN16
NC15
ISD33240
+2.2V
52
C3 1uF
C2 1uF
48
50
C4 1uF
MIC. INPUT
RADIO INPUT(L)
74HC4018
1Y0 VCO14
2Z0 E013
3Z1 E312
4Y1 Y311
5E1 Z310
6E2 Z209
7GND Y208
46
C5 1uF
56 C6 1uF
60
R5
58
R4
54
C7 1uF
INPUT TO POWER SECTION (L) OF JENSEN XCC8220

DIGITAL RECORDER FOR CAR RADIO

BACKGROUND OF THE INVENTION

This invention relates to recording information on an automobile radio either from within the auto, from a separate audio source or from the radio itself.

Frequently, while driving the driver wants to record information either because it is in the driver's mind, is information which has been or is being broadcast on the radio or is music so broadcast which the driver wants to record real time.

Previously, auto radios which included a separate record feature used the standard tape recorder found in auto radios. This mechanism generally proved unwieldy, expensive and not susceptible to widespread use.

Recently, digital recording has become more available for widespread use. This invention incorporates a digital recording mechanism within an auto radio so as to allow the digital recording system to record either from an oral source within the car or from the auto audio itself.

At present, the recording time which is available for digital recording is approximately seven minutes, but this may increase in the future. Additionally, when the digital memory is fully loaded, it will wrap around and record over previous recordings. The system operates by depressing command buttons or, alternatively, by orally instructing and commanding the auto radio.

The present system will be able to play back that which has been recorded through the auto sound system. When recording oral sounds using the microphone, the radio becomes muted so as to avoid background noise.

DETAILED DESCRIPTION

Figure 1:
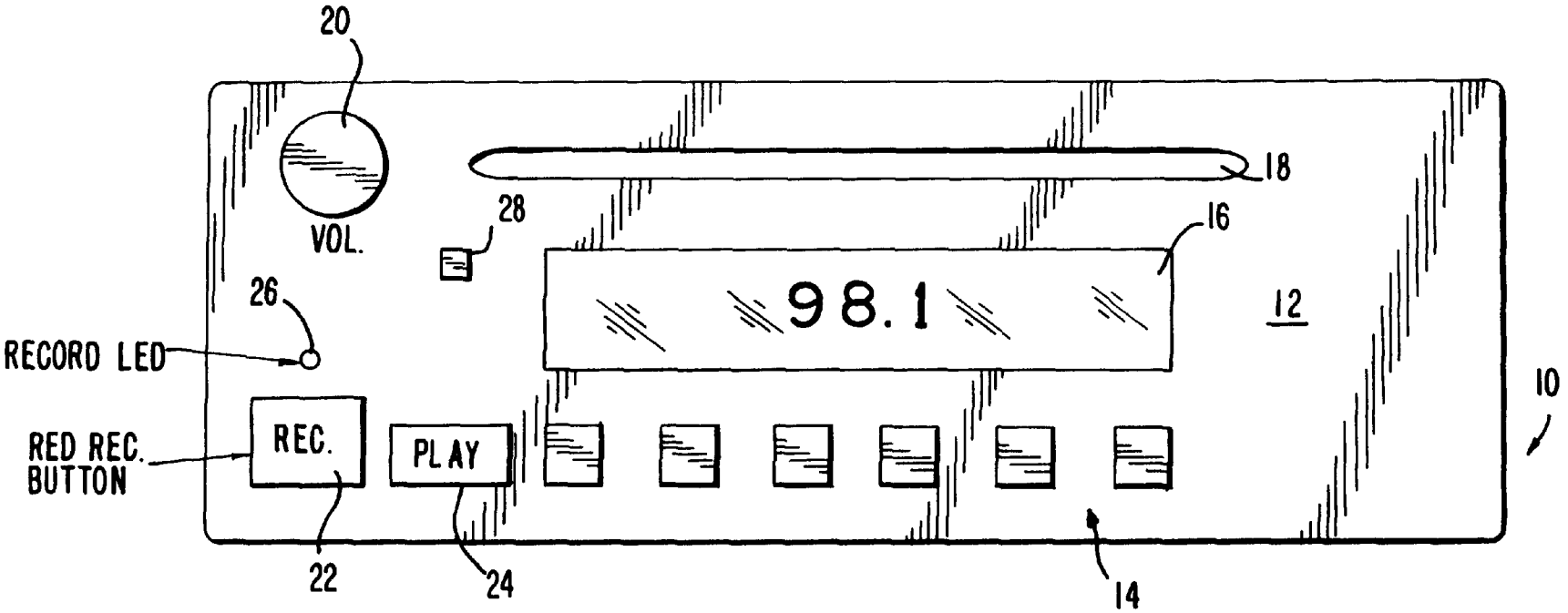
FIG. 1 is a front view of an auto radio with additional record and play buttons.

FIG. 1 illustrates the front panel 10 of auto radio 12 of an automobile, the front panel 10 comprising a plurality of conventional push buttons 14, a display panel 16, a CD receptacle 18, a volume control 20. In addition, and in accordance with this invention, a record button 22, a play button 24, an LED indicator 26 and a microphone 28 for voice recording is provided. An alternative embodiment incorporating a voice command system using the microphone 28 will also be described.

Figure 2:
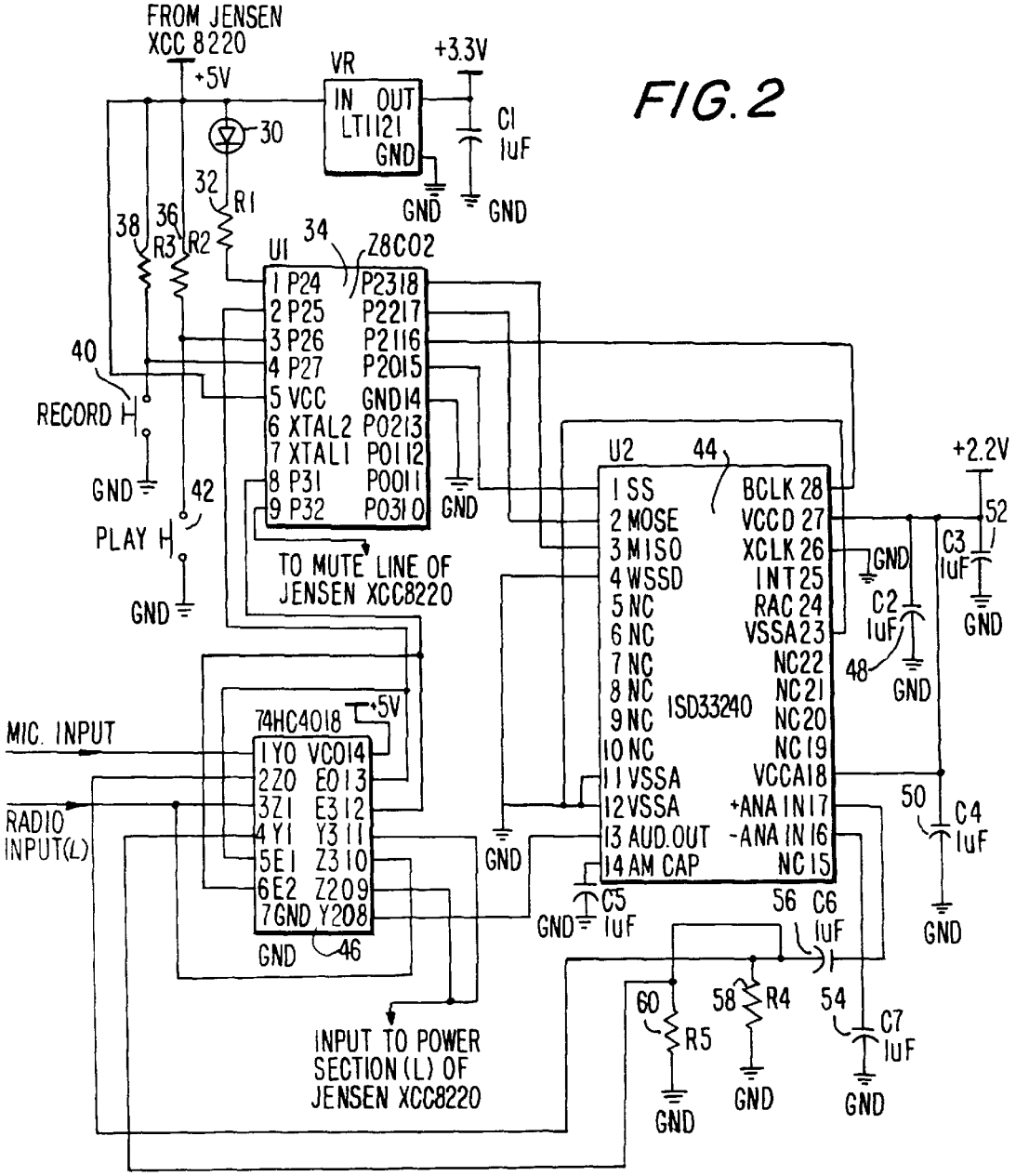
FIG. 2 is a schematic diagram of an embodiment of the left channel of this invention with the right channel being identical.

FIG. 2 illustrates a schematic diagram of an embodiment of this invention. The diagram of FIG. 2 is shown as operating with a Jensen XCC 8220 radio. This is a conventional radio available on the open market. Additionally, the electronic circuit of FIG. 2 comprises chips that are conventionally available, these being identified as an ISD 33240 which is a single chip voice record/playback device with a memory for storing the message; an 74HC4016 available from National Semiconductor which is an electronic switch which controls the direction of the audio input (radio or Mic) and output play radio or stored message; and a Zilog Z86C02 microprocessor which reads the key presses and processes commands accordingly. It controls the switch and ISD chip. Specific connections are made to specific pins of the chips as shown in FIG. 2, and one of ordinary skill in the art can practice the invention by using the identified chips, making the connections to the appropriate pins, utilizing components where illustrated in order to practice the invention. Additionally, Linear Technology LT1 121 chip is provided which is a five to 3.3 volt converter since the ISD chip requires 3.3 volts to properly operate.

The circuit of FIG. 2 is connected to the 5 volt input from a Jensen XCC8220 auto radio. Such 5 volt source is connected through a diode 30 (D1) connected in series to a 220 Ohm resistor 32 (R1) to pin 1 of Zilog microprocessor chip 34. The pin numbers of the chip are identified with the legend P1, while the port connector internal to the chip is identified on the right. Pin 3 is connected through a 47K Ohm resistor 36 (R2) to the 5 volt source while pin 4 is also connected through a 47K Ohm resistor 38 (R3) to the 5 volt source. Pin 4 is also connected through a record push button 40 to ground. Pin 3 is also connected through a play push button 42 to ground. Pin 18 of chip 34 is connected to pin 3 of ISD chip 44 while pin 17 of chip 34 is connected to pin 2 of ISD chip 44; pin 16 of chip 34 is connected to pin 28 of ISD chip 44; pin 15 of chip 34 is connected to pin 1 of ISD chip 44. Pin 14 of chip 34 is connected to ground. Pin 8 of chip 34 is connected to pin 13 of the electronic switch chip 46. Pin 8 of chip 34 is connected to the mute line of the Jensen XCC8220 receiver. A microphone input is connected to pin 1 of chip 46 while the radio input is connected to pin 3. Pins 9 and 11 of chip 46 are connected together and to the input to the left power section of the Jensen XCC8220 receiver. This system utilizes the left channel of the Jensen receiver, although a duplicate chip 46 for the right channel could be provided if such additional channel audio was desired. Note that 5 volts is supplied to pin 14 of chip 46. The left radio input is supplied not only to pin 3 but also to pin 10 f chip 46. Pins 8 and 9 of chip 34 are connected to pins 5 and 6 of chip 34 while also being connected to pins 13 and 14 respectively of chip 46. Pin 7 of chip 46 is connected to ground. Pin 8 of chip 6 is connected to pin 13 of the recorder playback chip 44. Pins 4, 11, 12, 23 and 26 of chip 44 are connected to ground. Pin 14 of chip 44 is connected through a 1 $\mu$F capacitor 46 (C5) to ground. Pin 27 of chip 44 is connected through a 0.1 $\mu$F capacitor 48 (C2)to ground as well as to pin 18 and through a 0.1 $\mu$F capacitor 50 (C4) to ground. Pin 27 is also connected to receive the 3.3 volt input with a spike detector comprising a 22 $\mu$F capacitor 52 (C3) to ground. Pin 16 of chip 44 is connected through a 0.1 $\mu$F capacitor 54 (C7) to ground. Pin 17 is connected through a 0.1 $\mu$F capacitor 56 (C6) to pin 2 of chip 46. Additionally, pin 2 of chip 46 is connected through a 47K Ohm resistor 58 (R4) to ground and through another 47K Ohm resistor 58 (R4) to ground. Pin 4 is connected to pin 2 while pine 3 is connected to pin 10 of chip 44. Pin 4 is also connected through a 47K Ohm resistor 60 (R5) to ground. Other pin connections are shown in FIG. 2.

Although only play and record functions are illustrated in FIG. 2, other functions such as review, cure and fast forward can be added by those skilled in the art. At present a minimum of 2 MB memory is desirable for about seven minutes of storage but larger memory capacity may be desirable. The diagram presented in FIG. 2 illustrates a preferred embodiment of the present invention for the left channel, and a duplicate is provided for the right channel if audio from such channel is desired.

Figure 3:
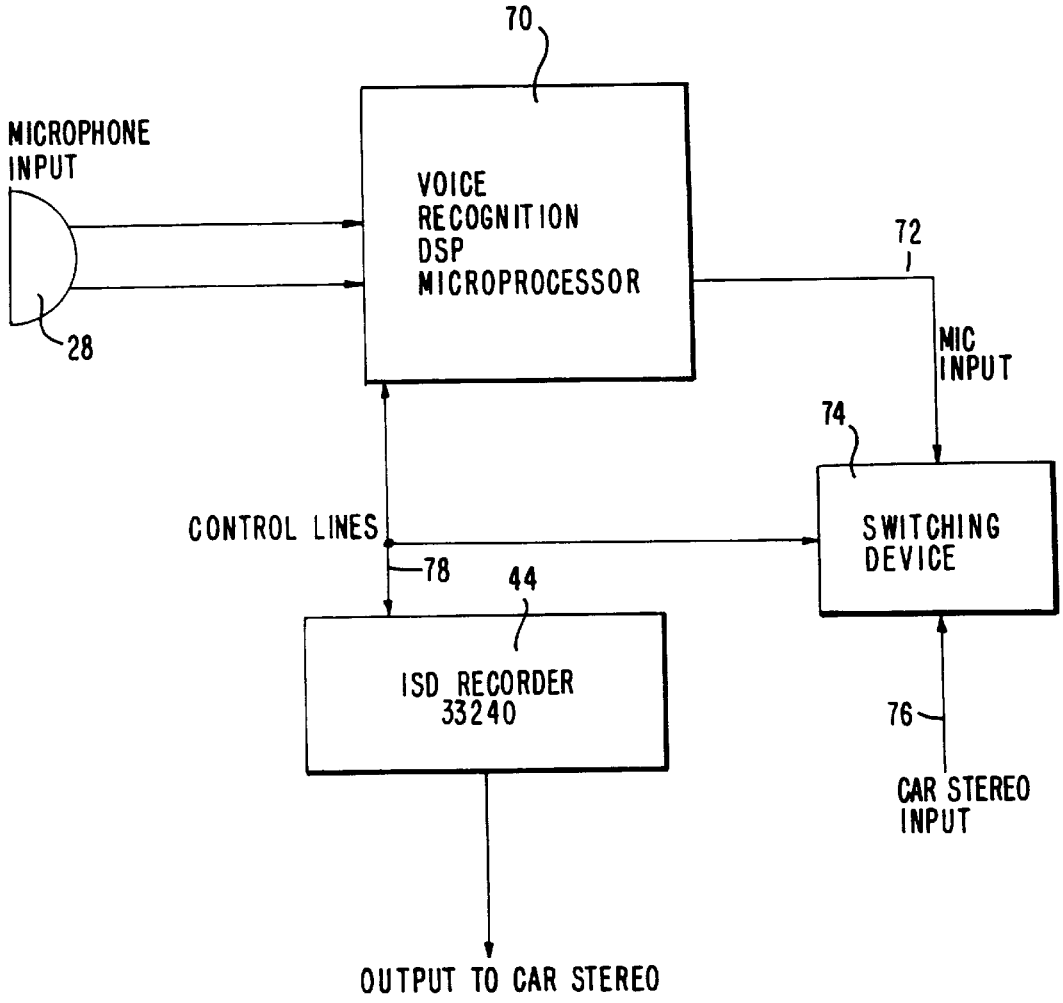
FIG. 3 is a block diagram of a voice control system which can control the digital recorder of FIGS. 1 and 2.

FIG. 3 is a block diagram of a voice control command system for the digital recorder of this invention.

Microphone 28 is employed as the input to a voice recognition DSP microprocessor 70. One output of microprocessor 70 is connected as a microphone input 72 to switching device 74; another input to switching device 74 is supplied from the car stereo input 76. Switching device 74 is connected through control lines 78 to transmit or receive information from microprocessor 70 and ISD recorder 33240 which is the same ISD microrecorder 44 as found in FIG. 2. ISD recorder 44 supplies its output to the car stereo in the manner as described with respect to FIG. 2. The voice recognition DSP microprocessor can receive and understand voice commands such as record/radio, record/voice, play, next message, and many other oral commands. Depending upon the oral command, switching device 74 connected to control lines 78 will provide command signals to control the operation of the digital recorder, much as the manual push buttons 22 and 24 would do if the manual system were the command control system for this invention.

This invention is described with reference to the present embodiment. The scope of protection for the invention is that defined by the claims appended hereto. Reasonable modifications, changes and variations may be made by those of ordinary skill in the art which will fall within the scope of the appended claims.

What is claimed is:

1. An automobile radio digital recording combination comprising an automobile radio system comprising a receiver section and an audio section, a digital recording system comprising a digital memory, a microphone and an electronic circuit connected between said microphone and said digital memory, said microphone mounted in said radio to pick up verbal information, manually actuable means to permit recording in said digital recording system through said microphone to permit an automobile occupant to record a message, muting means connected to said manually actuable means to mute audio sounds emanating from said automobile radio system while said digital recording system is recording said verbal information through said microphone, said digital recording system comprising means to generate signals representative of and play back information stored therein, said audio section of said automobile radio connected to said digital recording system to audibly reproduce through said audio section said verbal information stored in said digital recording system, said automobile radio digital recording combination using the radio to either playback said verbal information stored or the audio sounds emanating from said automobile radio system so that said verbal information stored or the audio sounds can be heard within the automobile.

2. An automobile radio digital recording combination according to claim 1, wherein said digital memory comprises at least one megabyte of storage.

3. An automobile radio digital recording combination according to claim 1, wherein said receiver section of said automobile radio is connected through said electronic circuit to said digital memory, actuable means connecting either said receiver section of said radio or said microphone to said digital memory to effect storage of respective signals.

4. An automobile radio digital recording combination according to claim 1, wherein said digital recording system is capable of storing at least five minutes of information.

5. An automobile radio digital recording combination according to claim 1, wherein said electronic circuit comprises programmable computer chips.

6. An automobile radio digital recording combination according to claim 1, wherein said manually actuable means comprises at least a manual push button for record functions.

7. An automobile radio digital recording combination according to claim 6, wherein said manually actuable means comprises at least a manual push button to actuate playback of recorded information.

8. An automobile radio digital recording combination according to claim 7, further comprising an oral command to receive and decode oral commands to control said digital recorder.

9. An automobile radio digital recording combination according to claim 1, further comprising light means to indicate when said digital recording system is in record mode.

10. An automobile radio digital recording combination according to claim 1, wherein said microphone is mounted in the front panel of said automobile radio.

11. An automobile radio digital recording combination comprising an automobile radio system comprising a receiver section and an audio section, a digital recording system comprising a digital memory, a microphone and an electronic circuit connected between said microphone and said digital memory, said microphone mounted in said radio to pick up verbal information, actuable means to permit recording in said digital recording system through said microphone to permit an automobile occupant to record a message, muting means connected to said actuable means to mute audio sounds emanating from said automobile radio system while said digital recording system is recording said verbal information through said microphone, said digital recording system comprising means to generate signals representative of and play back information stored therein, said audio section of said automobile radio connected to said digital recording system to audibly reproduce through said audio section said verbal information stored in said digital recording system, said automobile radio digital recording combination using the radio to either playback said verbal information stored or the audio sounds emanating from said automobile radio system so that said verbal information stored or the audio sounds can be heard within the automobile.

12. An automobile radio digital recording combination according to claim 11, wherein said actuable means comprises voice recognition means connected to said microphone to generate control command signals.

13. An automobile radio digital recording combination according to claim 12, wherein said actuable means also comprise manually actuable means to generate said control command signals.

14. An automobile radio digital recording combination according to claim 12, wherein said control command signals comprise a play command and a record command signal.

15. An automobile radio digital recording combination according to claim 12, wherein said control command signals comprise a play command and a record command signal.

16. An automobile radio digital recording combination according to claim 11, wherein said receiver section of said automobile radio is connected through said electronic circuit to said digital memory, actuable means capable of connecting either said receiver section of said radio on said microphone to said digital memory to effect storage of a respective signal.

17. An automobile radio digital recording combination according to claim 11, wherein said digital recording system is capable of storing at least five minutes of information.

18. An automobile radio digital recording combination according to claim 11, wherein said electronic circuit comprises programmable electronic computer chips.

19. An automobile radio digital recording combination according to claim 11, further comprising light means to indicate when said digital recording system is in record mode.

20. An automobile radio digital recording combination according to claim 11, wherein said digital memory comprises at least one megabyte of storage.

21. An automobile radio digital recording combination according to claim 11, wherein said microphone is mounted in the front panel of said automobile radio.

* * * * *